US005591933A

United States Patent [19]

Li et al.

[11] Patent Number: 5,591,933

[45] Date of Patent: Jan. 7, 1997

[54] CONSTRUCTIONS HAVING IMPROVED PENETRATION RESISTANCE

[75] Inventors: Hsin L. Li, Parsippany; Young D. Kwon, Mendham; Kwok W. Lem, Randolph; Dusan C. Prevorsek, Morristown, all of N.J.

[73] Assignee: AlliedSignal Inc., Morristown, N.J.

[21] Appl. No.: 492,587

[22] Filed: Jun. 20, 1995

Related U.S. Application Data

[63] Continuation of Ser. No. 75,359, Jun. 14, 1993, abandoned, which is a continuation of Ser. No. 891,147, Jun. 1, 1992, abandoned.

[51] Int. Cl.[6] ..... F41H 5/04

[52] U.S. Cl. ..... 89/36.02; 156/93; 428/102; 428/911

[58] Field of Search ..... 2/2.5; 89/36.02; 156/93; 428/102, 113, 911

[56] References Cited

U.S. PATENT DOCUMENTS

| | | | |
|---|---|---|---|
| 3,562,810 | 2/1971 | Davis | 2/2.5 |
| 3,702,593 | 11/1972 | Fine | 89/36.02 |
| 3,739,731 | 6/1973 | Tabor | 89/36.01 |
| 3,841,954 | 10/1974 | Lawler | 428/102 |
| 3,971,072 | 7/1976 | Armellino | 2/2.5 |
| 3,988,780 | 11/1976 | Armellino | 2/2.5 |
| 4,331,495 | 5/1982 | Lackman et al. | 156/93 |
| 4,550,045 | 10/1985 | Hutson | 428/102 |
| 4,613,535 | 9/1986 | Harpell et al. | 428/113 |
| 4,622,254 | 11/1986 | Nishimura et al. | 428/102 |
| 4,623,574 | 11/1986 | Harpell et al. | 428/113 |
| 4,650,710 | 3/1987 | Harpell et al. | 428/263 |
| 4,916,000 | 4/1990 | Li et al. | 428/105 |
| 5,019,435 | 5/1991 | Cahuzac et al. | 428/113 |
| 5,196,252 | 3/1993 | Harpell | 428/102 |
| 5,350,615 | 9/1994 | Darrieux | 428/113 |

FOREIGN PATENT DOCUMENTS

| | | | |
|---|---|---|---|
| 0131447 | 1/1985 | European Pat. Off. . | |
| 0299503 | 1/1989 | European Pat. Off. . | |
| 2931110 | 2/1981 | Germany | 2/2.5 |
| 133042 | 7/1984 | Japan | 156/93 |
| 9208607 | 5/1992 | WIPO . | |

*Primary Examiner*—Stephen C. Bentley

*Attorney, Agent, or Firm*—Renee J. Rymarz; Melanie L. Brown

[57] ABSTRACT

A rigid improved penetration resistant composite of the type comprising a plurality of fibrous layers comprising network of fibers in a polymeric matrix selected from the group consisting of thermoplastic polymers, thermosetting resins or a combination thereof, at least two of said layers secured together by a securing means, said improvement comprising a securing means which comprises fiber stitches wherein the average stitch length is greater than the average stitch path, a process for forming the composite and articles fabricated from said composite.

13 Claims, 4 Drawing Sheets

CONSTRUCTIONS HAVING IMPROVED PENETRATION RESISTANCE

This application is a continuation of application Ser. No. 08/075,359 Filed Jun. 14, 1993, now abandoned, which is a continuation of Ser. No. 07/891,147 filed Jun. 1, 1992, now abandoned.

BACKGROUND OF THE INVENTION

1. Field of the Invention

This invention relates to articles having improved resistance to forces such as, for example, those generated by penetration by ballistic projectiles, pointed objected (e.g. knives, icepicks, etc.) and the like and the effect of explosive blast. More particularly, this invention relates to such articles which are fiber based and which are especially suitable for fabrication into penetration and blast resistant articles such as ballistic armor in the form of, for example, helmets, shields which are resistant to impact by ballistic projectiles, portable barricades and armor panel inserts for briefcases, spall liners for military vehicles personnel carriers and tanks, aircraft armor, seats in military vehicles, panels, explosive containers and explosion resistant cargo containers for aircraft and the like.

2. Prior Art

Ballistic articles such as helmets, structural members of helicopters and other military equipment, and vehicle panels, containing high strength fibers are known. Illustrative of such articles are those described in U.S. Pat. Nos. 3,971,072; 3,988,780; 4,183,097; 3,855,632; 4,522,871; 4,510,200; 4,623,574; 4,748,064; 4,916,000; 4,403,012; 4,457,985; 4,650,710; 4,681,792; 4,737,401; 4,543,286; 4,563,392; and 4,501,856.

SUMMARY OF THE INVENTION

This invention relates to a rigid penetration resistant composite comprising a plurality of fibrous layers, said fibrous layers comprised of a network of fibers dispersed in a polymeric matrix, at least two of said layers secured together by a plurality of stitches preferably extending along at least two spaced paths, which spaced paths are preferably adjacent or substantially adjacent paths, said stitches having a stitch length and a stitch path, wherein all or substantially all of said stitches have a stitch length which is greater than the length of the stitch path. Another embodiment of this invention relates to an article of manufacture comprising a body which is constructed totally or in part from the composite of this invention.

As used herein, the "penetration resistance" of the article is the resistance to penetration by a designated threat. Designated threats include physical objects such as, for example, bullets, fragments, shrapnel and the like. Threats also include non-physical objects such as blasts from explosions and the like. The penetration resistance for designated threats can be expressed by at least three methods: 1. V/50 is the velocity at which 50% of the threats will penetrate the composite while 50% will be stopped by the armor. For composite of equal areal density, which is the weight of the composite panel divided by the surface area, the higher the V/50, the better the resistance of the composite; 2. Total specific energy absorption (SEAT): SEAT is the kinetic energy of the threat divided by the areal density of the composite. The higher the SEAT value, the better the resistance of the composite to the threat; and 3. Striking velocity (V/s) vs. residual velocity (V/r): When a threat strikes an armor panel at a velocity of (V/s), the residual velocity (V/r) is measured after the threat penetrates the composite. The larger the difference between (V/s) and (V/r), the better the resistance to the threat for composite panels of equal areal density. In ballistic studies, the specific weight of the composites can be expressed in terms of the areal density (ADT). This areal density corresponds to the weight per unit area of the ballistic resistant armor. In the case of filament reinforced composites, the ballistic resistance of which depends mostly on filaments, another useful weight characteristic is the filament areal density of the composite. This term corresponds to the weight of the filament reinforcement per unit area of the composite (AD).

As used herein the "stitch length" is the stitch length of the stitch fiber from the exit from one surface of the composite to the next subsequent exit of the fiber from the one surface of the composite, i.e., the combination of the portion of the stitch from the exit of the stitch fiber out of a surface of the composite along one surface of the composite to the entrance of the stitch fiber through the one surface and into the composite, the portion of the stitch fiber passing through the composite to the exit of the stitch fiber onto the opposite surface of the composite, the portion of the stitch fiber from the exit on the opposite surface of the composite along the opposite surface of the composite to the entrance of the stitch fiber through the opposite surface and into the composite and the portion of the stitch that passes through the composite from the opposite surface to the exit of the stitch on said one surface; and the "length of the stitch path" is the linear distance traversed by the stitch from an exit of the stitch from a surface of the composite to the next subsequent exit of the stitch fiber from said surface of the composite i.e., the sum of the thickness of twice the composite plus the distance on the surface of the surfaces of the composite between the exit of the stitch fiber from a surface of the composite and the following entry of the stitch fiber into the surface of the composite.

As used herein, "rigid" means that the composite is not flexible. Rigidity is measured by clamping a 30 cm. composite horizontally along an edge with an overhang of 20 cm. and measuring the amount of drape of the composite and then rotating the composite by 90° and by 180° and again measuring the amount of drape of the composite at 90° and 180°. The amount of drape is measured by the vertical distance between the level of the clamped side edge and the opposite free edge. When the vertical distance is about 0 cm., the composite is said to be rigid.

Several advantages flow from this invention. For example, the articles and composite of this invention exhibit relatively improved penetration resistance as compared to other articles and composites of the same construction and composition but having stitch lengths and stitch paths outside the scope of this invention. The relationship between the stitch length and the stitch path controls the delamination of the composite to achieve optimum ballistic performance and to prevent separation of the composite due to impact. It has been discovered that controlled level of delamination is advantageous to penetration resistance because delamination consumes part of the total kinetic energy of the threat and less of the total energy is available to penetrate the composite, resulting in superior performance. Another advantage resulting from the relationship between the stitch length and the stitch path is improved multiple hit capability. Other advantages of the articles and composites of this invention will become apparent from the specification and claims.

This invention also relates to a process for fabricating the penetration resistant composite of this invention comprising the steps of:

a) stitching a plurality of adjacent fibrous layers, each of which comprises a network of fibers dispersed in a polymeric matrix, by a plurality of stitches having an average first stitch length and having an average first stitch path, wherein said first stitch length is equal to or substantially equal to said first stitch path to form a first composite having a first thickness, $t_1$; and b) compressing said first composite at a temperature and or pressure to form a penetration resistant second composite having a second thickness, $t_2$, a second stitch length and a second stitch path wherein said first thickness, $t_1$, is greater than said second thickness, $t_2$, said second stitch length is equal to or substantially equal to said first stitch length and wherein said second stitch path is less than said first stitch path.

BRIEF DESCRIPTION OF THE DRAWINGS

The invention will be more fully understood and further advantages will become apparent when reference is made to the following detailed description of the invention and the accompanying drawings in which:

FIG. 5 is a flow sheet identifying the steps of one process embodiment of the present invention.

DETAILED DESCRIPTION OF THE PREFERRED EMBODIMENTS OF THE INVENTION

The preferred embodiments of this invention will be better understood by those of skill in the art by reference to the above figures. The preferred embodiments of this invention illustrated in the figures are not intended to be exhaustive or to limit the invention to the precise form disclosed. They are chosen to describe or to best explain the principles of the invention and its application and practical use to thereby enable others skilled in the art to best utilize the invention.

Figure 1:
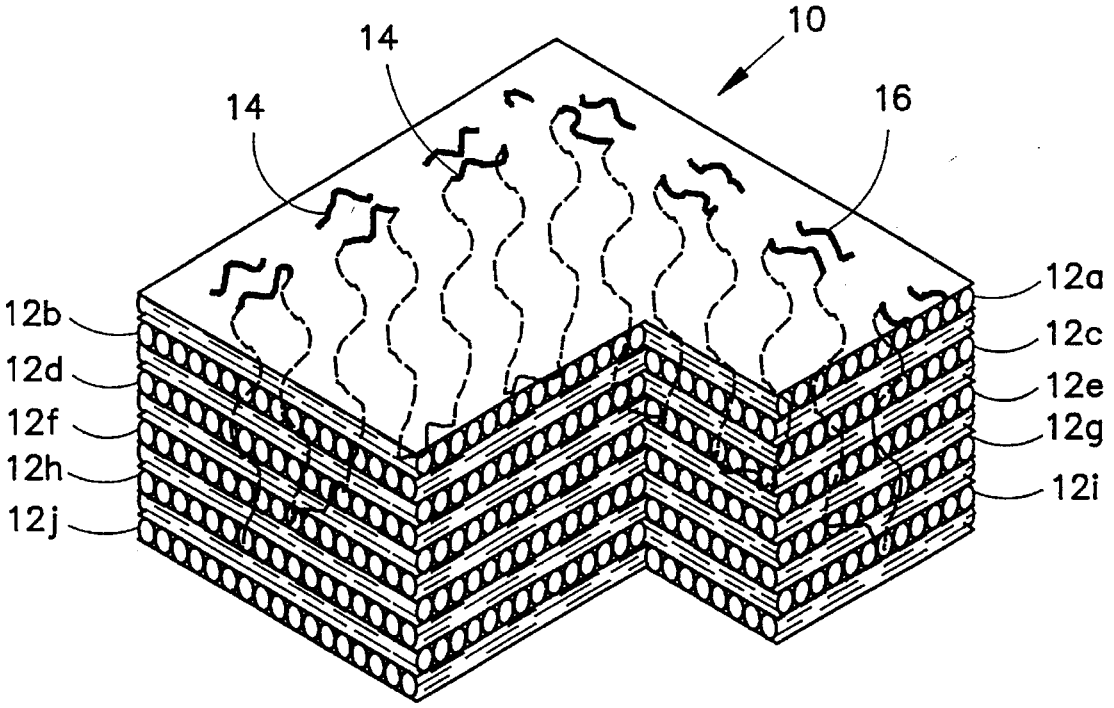
FIG. 1 is a fragmentary view of a preferred composite of this invention in which certain selected layers have been cut away.
Figure 2:
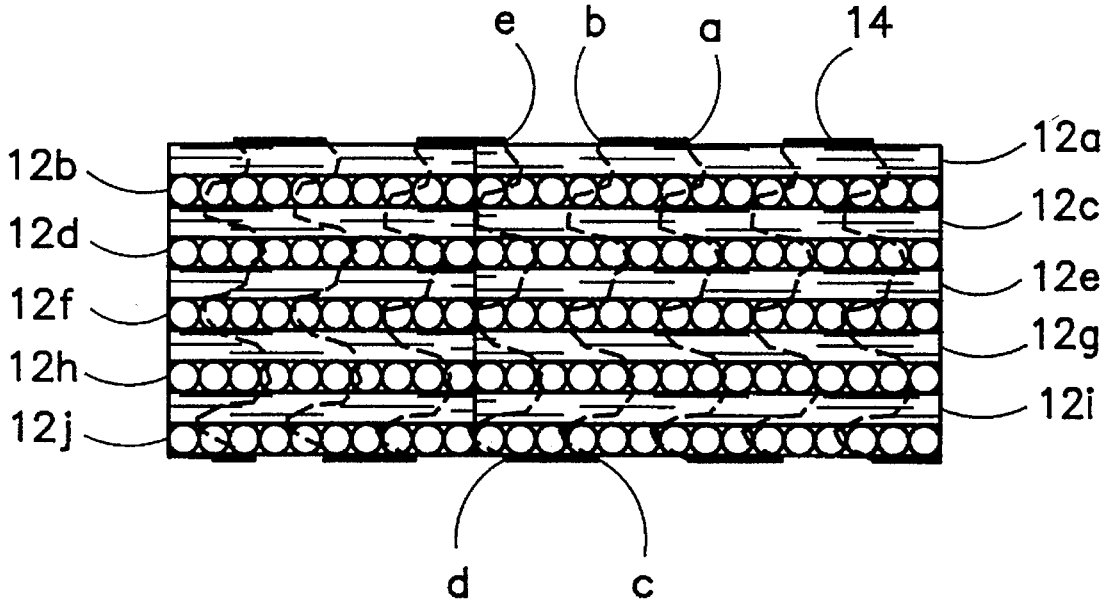
FIG. 2 is a side view of the preferred embodiment of this invention depicted in FIG. 1.
Figure 3:
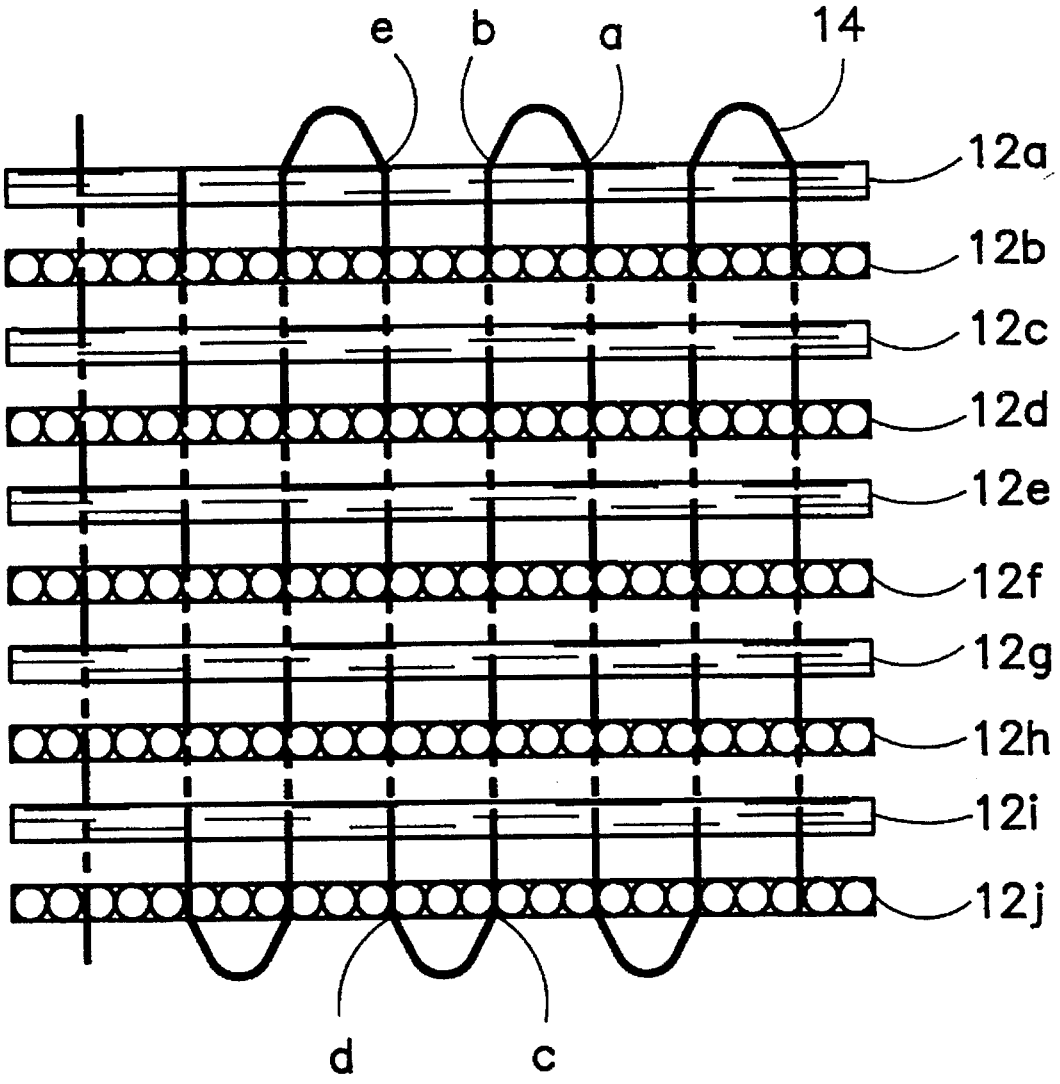
FIG. 3 is a side view of a precursor composite, not molded, corresponding to the composite of FIG. 2.

Referring to FIGS. 1 and 2, the numeral 10 indicates a penetration or blast resistant composite 10, which in this preferred embodiment of the invention is a penetration resistant body armor which comprises a plurality of resin impregnated fibrous layers 12*a* to 12*j* which are stitched together by a plurality of stitches 14 and 16. As shown in FIG. 2, stitches 14 and 16 have an average stitch length defined by the actual length of the stitch fiber from point "a" to point "e", and an average stitch path defined by the linear distance from point "a" to point "e". The relationship between the stitch path and the stitch length is critical to the advantages of this invention. In general, while the exact values of the stitch length and the stitch path may vary widely the stitch length must be greater than the stitch path. All stitches need not have the same or substantially the same stitch length or stitch path. The only requirement is that all or substantially all stitches have stitch paths and stitch lengths having the stated relationship. In the preferred embodiments of the invention, all or substantially all of the stitches have equal or substantially equal stitch lengths and equal or substantially equal stitch paths, where for any stitch, the stitch path and stitch length have the stated relationship. Usually, the stitch length is up to 300% of the stitch path. In the preferred embodiments of the invention the stitch length is from about 102 to about 300% of the stitch path. The stitch length is more preferably from about 105 to about 200% of the stitch path and is most preferably from about 105 to about 150% of the length of the stitch path. In the embodiments of this invention of choice, the stitch length is from about 110% to about 150% of the length of the stitch path.

The actual values of the stitch length and stitch path are not critical and may vary widely and depending on the use of the composite and desires of the fabricator provided that they have the required relationship. In most instances where the composite is for use in penetration or blast resistant applications, the stitch length and the length of the stitch path is equal to or less than about 11.4 cm. The stitch length is preferably from about 11.4 cm to about 1 cm and the stitch path is preferably from about 8.9 to about 0.64 cm; the stitch length is more preferably from about 9.5 to about 1 cm and the stitch path is more preferably from about 7.3 to about 0.64 cm; and the stitch length is most preferably from 7.7 to about 1.5 cm. the stitch path is most preferably from about 6.9 to about 0.96 cm.

The angle of the stitch path is not critical and may vary widely. As used herein, the "angle of the stitch path" is formed between two diverging lines drawn from a common point on the composite exterior surfaces where one line is the shortest distance drawn perpendicularly through the composite while the other line is the actual stitch path. Generally, the angle of the stitch path is equal to or less than about 90°. The angle of the stitch path is preferably from about 0° to about 60°, more preferably from about 0° to about 45° and most preferably from about 0° to about 30°.

The amount of stitches employed may vary widely. In general in penetration resistance applications, the amount of stitches employed is such that the stitches comprise less than about 10% of the total weight of the stitched fibrous layers. The weight percent of stitches is preferably from about 0.01 to about 10, more preferably from about 0.02 to about 5 and most preferably from about 0.05 to about 1, on the aforementioned basis.

Composite 10 may include stitches extending along a single path, or stitches extending along more than one path, which may be parallel or substantially parallel or which may intersect at an angle or a combination thereof. In the preferred embodiments of this invention, composite 10 includes stitches which extend along more than one path which are parallel or substantially parallel. An example of this embodiment of the invention can be represented by FIG. 1 which includes parallel or substantially parallel stitches 16 and parallel or substantially parallel stitches 14. In this preferred embodiment of the invention, the distance between parallel or substantially parallel stitch paths may vary widely. For penetration resistance applications such distance is generally equal to or less than about 10 cm, preferably from about 0.0254 to about 8 cm, more preferably from about 0.5 to about 5 cm and most preferably from about 0.5 to about 3 cm.

In another preferred embodiment of this invention depicted in FIG. 1, composite 10 includes two sets of stitches, parallel or substantially parallel stitches 14 and parallel or substantially parallel stitches 16 which intersect at an angle. The angle of intersection may vary widely. In general for penetration applications, the angle of intersection is from about 60° to about 150°, more preferably from about 75° to about 135°, and most preferably from about 85° to about 95°.

As depicted in FIG. 1, article 10 is comprised of ten layers 12*a* to 12*j*. However, the number of layers 12 included in article 10 may vary widely, provided that at least two layers are present. In general, the number of layers in any embodiment will vary depending on the degree of penetration resistance desired. In general, the greater the number of layers 12 the greater the penetration resistance of the composite, and the lesser the number of layers 12 the lower the penetration resistance of the composite. The number of fibrous layers 12 is preferably from 2 to about 1500, more preferably from about 10 to about 1400 and most preferably from about 40 to about 1000.

The type of stitches employed is not critical and may vary widely provided that the required relationship between stitch length and stitch path are provided. Stitching and sewing methods such as hand stitching, multi-thread chain stitching, over edge stitching, flat seam stitching, single thread lock stitching, lock stitching, chain stitching, zig-zag stitching and the like constitute the preferred securing means for use in this invention.

The fiber used to form stitches 14 and 16 in these preferred embodiments can vary widely. Useful fiber may have a relatively low modulus or a relatively high modulus and may have a relatively low tenacity or a relatively high tenacity. Fiber for use in stitches 14 and 16 preferably has a modulus equal to or greater than about 20 grams/denier and a tenacity equal to or greater than about 2 grams/denier. All tensile properties are evaluated by pulling a 10 in (25.4 cm) fiber length clamped with barrel clamps at 10 in/min (25.4 cm/min) on an Instron Tensile Tester. In the preferred embodiments of the invention, the modulus is equal to or greater than about 30 grams/denier and the tenacity is equal to or greater than about 4 grams/denier (preferably from about 6 to about 50 grams/denier), more preferably the modulus is from about 40 to about 3000 grams/denier and the tenacity is from about 8 to about 50 grams/denier and most preferably the modulus is from about 300 to about 3000 grams/denier and the tenacity is from about 10 to about 50 grams/denier. Useful threads and fibers may vary widely and will be described in more detail hereinbelow in the discussion of fiber for use in the fabrication of fibrous layers 12. Useful fibers may be formed from inorganic materials such as, for example, graphite, boron, silicon nitride, silicon carbide, glass (e.g. S-glass and E-glass) and the like. Useful fibers may also be formed from organic materials such as, for example, thermosetting and thermoplastic polymer. However, the thread or fiber used in stitching means is preferably formed from an organic material, more preferably a polymeric material and most preferably an aramid fiber or thread, an extended chain polyethylene thread or fiber, a nylon (e.g. nylon 6, nylon 11, nylon 6,10 and nylon 6,6) thread or fiber, liquid crystalline copolyester thread or fiber, or mixtures thereof.

Fibrous layer 12 comprises a network of fibers in a polymeric matrix. For purposes of the present invention, fiber is defined as an elongated body, the length dimension of which is much greater than the dimensions of width and thickness. Accordingly, the term fiber as used herein includes a monofilament elongated body, a multifilament elongated body, ribbon, strip and the like having regular or irregular cross sections. The term fibers includes a plurality of any one or combination of the above.

The cross-section of fibers for use in this invention may vary widely. Useful fibers may have a circular cross-section, oblong cross-section or irregular or regular multi-lobal cross-section having one or more regular or irregular lobes projecting from the linear or longitudinal axis of the fibers. In the particularly preferred embodiments of the invention, the fibers are of substantially circular or oblong cross-section and in the most preferred embodiments are of circular or substantially circular cross-section.

The type of fiber used in the fabrication of fibrous layer 12 may vary widely and is preferably an organic fiber. Preferred fibers for use in the practice of this invention are those having a tenacity equal to or greater than about 7 grams/denier (g/d), a tensile modulus equal to or greater than about 50 g/d and an energy-to-break equal to or greater than about 30 joules/grams. The tensile properties are determined by an Instron Tensile Tester by pulling the fiber at 10 in (25.4 cm) fiber length, clamped in barrel clamps at 10 in/min (25.4 cm/min). Among these particularly preferred embodiments, most preferred are those embodiments in which the tenacity of the fiber is equal to or greater than about 15 g/d, the tensile modulus is equal to or greater than about 300 g/d, and the energy-to-break is equal to or greater than about 20 joules/grams. In the practice of this invention, fiber of choice has a tenacity equal to or greater than about 20 g/d, the tensile modulus is equal to or greater than about 1300 g/d and the energy-to-break is equal to or greater than about 40 joules/grams.

The denier of the fiber may vary widely. In general, fiber denier is equal to or less than about 20,000. In the preferred embodiments of the invention, fiber denier is from about 10 to about 20,000, the more preferred embodiments of the invention fiber denier is from about 10 to about 10,000 and in the most preferred embodiments of the invention, fiber denier is from about 100 to about 10,000. Preferably, yarn or fibers for use in the invention consists of multi-ends of filaments. The denier of each filament preferably varies from about 1 to about 25 denier.

Illustrative of useful organic fiber are those composed of thermosetting resins and thermoplastic polymers such as polyesters; polyolefins; polyetheramides; fluoropolymers; polyethers; celluloses; phenolics; polyesteramides; polyurethanes; epoxies; aminoplastics; polysulfones; polyetherketones; polyetherether-ketones; polyesterimides; polyphenylene sulfides; polyether acryl ketones; poly(amideimides); polyimides; aramids (aromatic polyamides), such as poly(2,2,2-trimethyl-hexamethylene terephthalamide) (Kevlar) and the like; aliphatic and cycloaliphatic polyamides, such as polyhexamethylene adipamide (nylon 66), polycaprolactam (nylon 6) and the like; and aliphatic, cycloaliphatic and aromatic polyesters such as poly (1,4-cyclohexlidene dimethylene terephathalate) cis and trans, poly(ethylene terephthalate) and the like.

Also illustrative of useful organic filaments are those of liquid crystalline polymers such as lyotropic liquid crystalline polymers which include polypeptides such as polybenzyl L-glutamate and the like; aromatic polyamides such as poly(1,4-benzamide), poly(4,4'-biphenylene 4,4'-bibenzo amide), poly(1,4-phenylene 4,4'-terephenylene amide), poly(1,4-phenylene 2,6-naphthal amide), and the like; polyoxamides such as those derived from 2,2'-dimethyl-4,4'diamino biphenyl, chloro-1,4-phenylene diamine and the like; polyhydrazides such as poly chloroterephthalic hydrazide and the like; poly(amide hydrazides such as poly(terephthaloyl 1,4-amino-benzhydrazide) and those prepared from 4-amino-benzhydrazide, oxalic dihydrazide, terephthalic dihydrazide and para-aromatic diacid chlorides; polyesters such as poly(oxy-trans-1,4-cyclohexyleneoxycarbonyl-trans-1,4-cyclohexylenecarbonyl-trans-1,4-phenyleneoxyterephthaloyl), poly(oxy-trans-1,4-cyclohexylene-oxycarbonyl-trans-1,4-cyclohexylenecarbonyl-b-oxy-(2-methyl 1,4-phenylene)oxy-terephthaloyl)], and the like; polyazomethines such as those prepared from 4,4'-diaminobenzanilide and terephthalaldephide, methyl-1,4-phenylenediamine and terephthalaldelyde and the like; polyisocyanides such as poly(-phenyl ethyl isocyanide), poly(n-octyl isocyanide) and the like; polyisocyanates such as poly (n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisoxazole)(PBO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phneylene)-4-phenylquinoline], poly[1,1'-biphenylene)-6,6'-bis(4-phenylquinoline)] and the like; polyorganophosphazines such as polyphosphazine, polybisphenoxyphosphazine, poly]bis(2,2,2'-trifluoroethyelene) phosphazine and the like; metal polymers such as those derived by condensation of trans-bis(tri-n-butylphosphine-)platinum dichloride with a bisacetylene or trans-bis(tri-n-butylphosphine)bis(1,4-butadinynyl) platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethyl ether cellulose, hydroxypropyl ether cellulose, carboxymethyl ether cellulose, ethyl hydroxyethyl ether cellulose, cyanoethylethyl ether cellulose, acetoxyethyl ether cellulose, benzoyloxypropyl ether cellulose, phenyl urethane cellulose and the like; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers and 6-hydroxy-2-naphthoic acid, terephthalic acid and hydroquinone, copolymers of 6-hydroxy-2-naphthoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-napthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorophydroquinone, terephthalic acid and ethylene dioxy-4,4'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly(amide-esters).

In the most preferred embodiments of the invention, composite articles include a filament network, which may include a high molecular weight polyethylene fiber, nylon 6 or nylon 66 fiber, an aramid fiber, a fiber formed from liquid crystalline polymers such as liquid crystalline copolyester and mixtures thereof. U.S. Pat. No. 4,457,985 generally discusses such high molecular weight polyethylene fibers and the disclosure of this patent is hereby incorporated by reference to the extent that it is not inconsistent herewith. In the case of polyethylene, suitable filaments are those of molecular weight of at least 150,000, preferably at least one million and more preferably between two million and five million. Such extended chain polyethylene (ECPE) filaments may be grown in solution as described in U.S. Pat. No. 4,137,394 or U.S. Pat. No. 4,356,138 or a filament spun from a solution to form a gel structure, as described in German Off. 3,004,699 and GB 2051667, and especially described in U.S. Pat. No. 4,551,296 (see EPA 64,167, published Nov. 10, 1982). As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 wt % of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as anti-oxidants, lubricants, ultra-violet screening agents, colorants and the like which are commonly incorporated by reference. Depending upon the formation technique, the draw ratio and temperatures, and other conditions, a variety of properties can be imparted to these filaments. The tenacity of the filaments should be at least 15 grams/denier, preferably at least 20 grams/denier, more preferably at least 25 grams/denier and most preferably at least 30 grams/denier. Similarly, the tensile modulus of the filaments, as measured by an Instron tensile testing machine, is at least 300 grams/denier, preferably at least 500 grams/denier and more preferably at least 1,000 grams/denier and most preferably at least 1,200 grams/denier. These highest values for tensile modulus and tenacity are generally obtainable only by employing solution grown or gel filament processes.

In the case of aramid fibers, suitable aramid fibers formed principally from aromatic polyamide are described in U.S. Pat. No. 3,671,542, which is hereby incorporated by reference. Preferred aramid fibers will have a tenacity of at least about 20 g/d, a tensile modulus of at least about 400 g/d and an energy-to-break at least about 8 joules/gram, and particularly preferred aramid fibers will have a tenacity of at least about 20 g/d, a modulus of at least about 480 g/d and an energy-to-break of at least about 20 joules/gram. Most preferred aramid fibers will have a tenacity of at least about 20 g/denier, a modulus of at least about 900 g/denier and an energy-to-break of at least about 30 joules/gram. For example, poly(phenylene terephthalamide) fibers produced commercially by Dupont Corporation under the trade name of KEVLAR 29, 49, 129 and 149 having moderately high moduli and tenacity values are particularly useful in forming ballistic resistant composites. Also useful in the practice of this invention is poly(metaphenylene isophthalamide) fibers produced commercially by Dupont under the trade name NOMEX.

In the case of liquid crystal copolyesters, suitable fibers are disclosed, for example, in U.S. Pat. Nos. 3,975,487; 4,118,372; and 4,161,470, hereby incorporated by reference. Tenacities of about 15 to about 30 g/d and preferably about 20 to about 25 g/d, and modulus of about 500 to 1500 g/d and preferably about 1000 to about 1200 g/d, are particularly desirable.

Fibers in fibrous layers 12 may be arranged in networks (which can have various configurations) embedded or substantially embedded in a polymeric matrix which preferably substantially coats each filament contained in the fiber bundle. The manner in which the fibers are dispersed or embedded in the polymeric matrix may vary widely. For example, a plurality of filaments can be grouped together to form a twisted or untwisted yarn bundles in various alignment. The fibers may be formed as a felt, knitted or woven (plain, basket, satin and crow feet weaves, etc.) into a network, fabricated into non-woven fabric, arranged in parallel array, layered, or formed into a woven fabric by any of a variety of conventional techniques. Among these techniques, for ballistic resistance applications we prefer to use those variations commonly employed in the preparation or aramid fabrics for ballistic-resistant articles. For example, the techniques described in U.S. Pat. No. 4,181,768 and in M. R. Silyquist et al., *J. Macromol Sci. Chem.,* A7(1), pp. 203 et. seq. (1973) are particularly suitable. In preferred embodiments of the invention, the fibers in each layer 12 are aligned substantially parallel and unidirectionally to form uniaxial layers 12 such as in a prepreg, pultruded sheet and the like.

Wetting and adhesion of fibers in the polymer matrices, is enhanced by prior treatment of the surface of the fibers. The method of surface treatment may be chemical, physical or a combination of chemical and physical actions. Examples of purely chemical treatments are used of $SO_3$ or chlorosulfonic acid. Examples of combined chemical and physical treatments are corona discharge treatment or plasma treatment using one of several commonly available machines.

The matrix material may vary widely and may be formed of any thermoplastic polymer, thermosetting resin or a mixture thereof. Suitable polymeric matrix materials include those mentioned below for use in the formation of the fibers of layer 12. Useful matrix polymer materials may exhibit relatively high modulus e.g. equal to or less than about 500 psi (3450 kPa) or may exhibit relatively high modulus e.g. greater than about 500 psi (3450 k Pa).

In one preferred embodiment of the invention the matrix material is a relatively high modulus blend of one or more thermoplastic polymers and one or more thermosetting resins. The choice of thermoplastic polymer and thermosetting resin and their relative amounts may vary widely depending on the desired characteristics of the composite. Useful matrix materials are described in more detail in PCT WO 91/08895 and are preferably a mixture of thermosetting vinyl ester resin and a thermoplastic polyurethane.

In another preferred embodiment of this invention the matrix material is selected from the group consisting of relatively low modulus elastomeric materials. A wide variety of elastomeric materials and formulation may be utilized in the preferred embodiments of this invention. Representative examples of suitable elastomeric materials for use in the formation of the matrix are those which have their structures, properties, and formulation together with cross-linking procedures summarized in the Encyclopedia of Polymer Science, Volume 5 in the section Elastomers-Synthetic (John Wiley & Sons Inc., 1964) and those which are described in U.S. Pat. No. 4,916,000 and are preferably block copolymers of conjugated dienes such as butadiene and isoprene are vinyl aromatic monomers such as styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multiblock copolymers of the type (AB)n (n=2–10) or radial configuration copolymers of the type R-(BA)x (x=3–150); wherein A is a block from a polyvinyl aromatic monomer and B is a block from a conjugated dien elastomer. Many of these polymers are produced commercially by the Shell Chemical Co. and described in the bulletin "KRATON Thermoplastic Rubber", SC-68-81.

The volume ratios of resin to fiber may vary. In general, the volume percent of the resin may vary from about 5 to about 70 vol. % based on the total volume of layer 12. In the preferred embodiments of the invention, the volume percent of the resin is from about 5 to about 50 vol. %, in the more preferred embodiments of this invention is from about 10 to about 40 vol. % and in the most preferred embodiments of this invention is from about 15 to about 30 vol. % on the aforementioned basis.

Layers 12 can be fabricated using conventional procedures. For example, layer 12 is formed by making the combination of fibers and matrix material in the desired configurations (such as a woven or non-woven fabric and layers in which fibers are aligned in a substantially parallel, unidirectional fashion), and amounts, and then subjecting the combination to heat and pressure using conventional procedures as for example those described in U.S. Pat. No. 4,916,000; 4,403,012; 4,737,401; 4,623,574; and 4,501,856; and PCT WO/91/08895.

Composite 10 can be formed by any conventional procedure. For example, one such procedure involves pre-forming a multilayer laminate and thereafter subjecting the laminate to a suitable stitching procedure such as sewing or drilling holes and guiding yarn through the holes to form composite 10 in which the stitch length is greater than the stitch path. One such procedure where composite 10 comprises fibrous layers where the fiber network is a knitted, woven or non-woven fabric involves aligning the desired number of layers formed of knitted, woven or non-woven fabric in a polymeric matrix and thereafter molding said aligned layers 12 at a suitable temperature and pressure to form a laminate structure of the desired thickness which can be stitched employing suitable stitching means such that the stitch length is greater than the stitch path. Another suitable procedure is where composite 10 comprises a laminate comprised of a plurality of layers 12 in the which polymer forming the matrix coats or substantially coats the filaments of multi-filament fibers and the coated fibers are arranged in a sheet-like array and aligned parallel to one another along a common fiber direction. Successive layers of such coated, uni-directional fibers can be rotated with respect to the previous layer to form a laminated structure 10. An example of such laminate structures are composites with the second, third, fourth and fifth layers rotated +45°, –45°, 90° and 0°, with respect to the first layer, but not necessarily in that order. Other examples include composites with 0°/90° layout of yarn or filaments. The laminates composed of the desired number of layers 12 can be molded at a suitable temperature pressure to form a precomposite having a desired thickness. Techniques for fabricating these laminated structures are described in greater detail in U.S. Pat. Nos. 4,916,000; 4,623,574; 4,748,064; 4,457,985 and 4,403,012. The laminated layers can be stitched together using a suitable stitching means such that the stitch length is greater than the stitch path. Suitable stitching means include sewing machines, combination of drills and needles, and the like to form composite 10.

Figure 4:
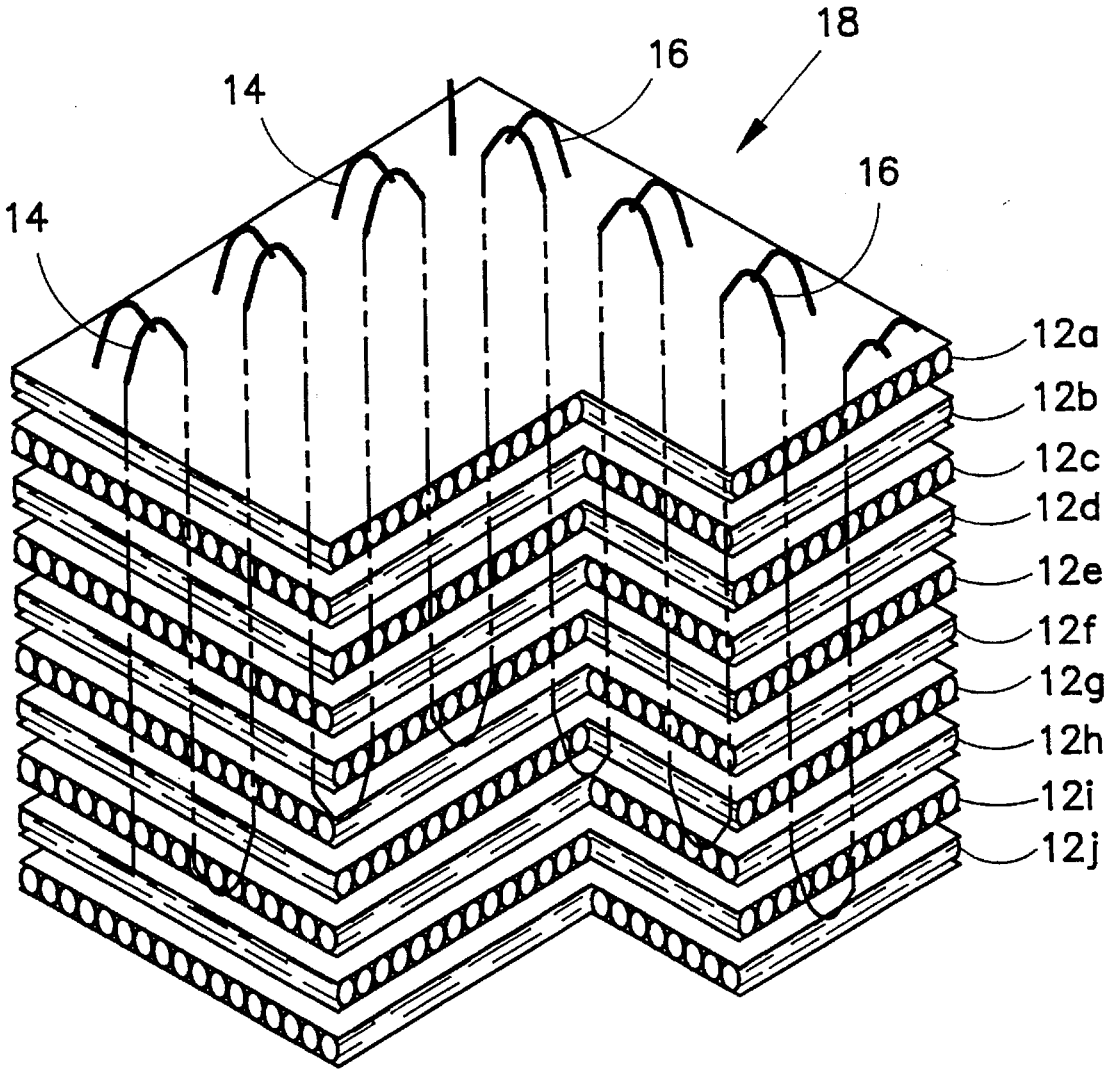
FIG. 4 is a fragmentary view of a precursor composite of the composite of FIG. 1.

In the preferred embodiment of this invention, composite 10 is prepared by the process of this invention. The first step of this process involves forming a laminate formed of a plurality of layers 12 by aligning adjacent layers in the desired configuration as described above and molding said aligned layers at a first temperature and first pressure sufficiently low to form a laminate having a thickness, $t_1$, and which is such that the laminate can be stitched by a suitable stitching means such that the first stitch length of said laminate is equal to or substantially equal to the first stitch path of said laminate as depicted in FIG. 4. First pressures and first temperatures employed in the formation of the laminate are preferably equal to or less than about 80° C. and 3,000 Kpa, respectively, more preferably from about 20° C. to about 50° C. and from about 200 to about 2,000 kPa, respectively, and most preferably from about 20° C. to about 30° C. and about 300 to about 1,000 kPa, respectively.

The laminate is stitched using the desired stitching means such that the stitch length is equal to or substantially equal to the stitch path and such that the laminate has a thickness, $t_1$. The laminate is then molded at a second temperature which is greater than the first temperature and/or a second pressure which is greater than the first pressure to form the composite of this invention having a thickness, $t_2$, which is less than the thickness, $t_1$, of said laminate, and having a second stitch path which is less than the first stitch path of said laminate and having a second stitch length which is equal to or substantially equal to said first stitch length of said laminate and which is greater than the second stitch path of said laminate. Second temperatures and second pressures are preferably equal to or greater than about 50° C. and about 700 kPa, respectively. Second temperatures and second pressures are more preferably from about 80° C. to about 400° C. and from about 700 kPa to about 30,000 kPa, respectively, and most preferably from about 110° C. to about 350° C. and from about 5,000 to about 20,000 kPa, respectively. While we do not wish to be bound by any theory, it is believed that when the laminate is molded at the higher second temperature the viscosity of the polymeric matrix becomes lower at the higher second temperature such that under the molding pressure the matrix polymer flows to fill or substantially fill the voids and holes created during the stitching step resulting in enhanced penetration resistance. The molding procedure also compresses the laminate such that the thickness of the compressed composite is less than that of the laminate which also decreases the length of the stitch path of the resulting composite such that it is less than that of the laminate. The length of the fiber forming the stitch length in the laminate and in the resulting composite 10 are the same or substantially the same. In the resulting composite 10, that portion of the stitch length which exceeds the stitch path of the resulting composite 10 is retained or is substantially retained in the interior of composite 10.

FIG. 4 depicts an article 18 which differs from article 10 by the manner in which difference in the stitch path and stitch length is obtained. In composite 10 of FIG. 1 the difference is obtained by compressing the layers 12 of article 18 such that the length of the stitch length which exceeds the length of the path is inside primary of the compacted composite. However in article 18, the length of the stitch length which exceeds the stitch path is external to the composite.

The composites of this invention can be used for conventional purposes using conventional fabrication procedures. For example, such composites can be used in the fabrication of penetration and blast resistance articles and the like using conventional methods. The articles are particularly useful as vehicular armor or penetration resistant articles such as armor for tanks, airplanes, helicopters, armored personnel carriers and the like. The composite of this invention can be conveniently used for such purposes using conventional procedures and vehicles. The composite of this invention may also be used in the fabrication of blast resistant articles such as cargo compartments of aircraft, containers for explosives and the like.

The following examples are presented to provide a more complete understanding of the invention and are not to be construed as limitations thereon.

COMPARATIVE EXAMPLE I

A ballistic composite was prepared from a plurality or stack of uniaxial prepreg sheets. Each uniaxial prepreg sheets comprised of high strength extended chain polyethylene (ECPE) yarn, SPECTRA®-1000 (a product of Allied-Signal Inc.), impregnated with a KRATON D1107 thermoplastic elastomer (a polystyrene-polyisoprene-polystyrene block copolymer having 14% wt. % styrene and a product of Shell Chemical). SPECTRA®-1000 yarn has a tenacity of 33 grams/denier (gpd), a modulus of 1,500 grams/denier (gpd) and energy to break of 49 joules/gram. The elongation to break of the yarn was 3%, denier was 1,300 and an individual filament denier was 5.4, or 240 filaments per yarn end. Each filament has an approx. diameter of 0.001 in. (0.0026 cm).

Thermoplastic elastomer resin impregnated uniaxial sheets were prepared as described in U.S. Pat. No. 4,916,000. Resin coating system consisted of a resin applicator tube moving reciprocatingly across the width of the aligned SPECTRA®-1000 yarn while the liquid resin, PRINLIN (TM) -B7137X-1, was pumped through the resin applicator tube. PRINLIN is product of Pierce & Stevens Corp. which contains KRATON D-1107 in water emulsion, and the exact formulation is proprietary. Technical information about KRATON is described in the bulletin KRATON thermoplastic rubber, typical property guide KRATON D and KRATON G. It is indicated to have the NO. SC:68-81. KRATON D-1107 has a glass transition temp. of −55° C. and a modulus tested using ASTM-D462 with a jaw separation speed of 10 in/min. (25.4 cm/min) of 100 psi (690 Kpa) at 300% elongation.

PRINLIN resin was coated on the yarn web of approx. 24" (61 cm) wide×0.0027" (0.0069 cm) thick and the yarn web consisted of aligned 228 ends of Spectra®-1000 yarn, or 9.5 yarn ends/inch-web/width (3.74 yarn ends/cm-web/width). The web coated with Prinlin was supported on a silicone release paper and was pulled, at a speed of 20 ft/min. (6.1 m/sec), through a pair of nip rollers with a gap setting of approx. 0.026" (0.066 cm). The coated web passed through a gas fired oven at a temperature of 110° C. where water vapor was vented out to ambient. The release paper was then peeled away from the resin impregnated sheet, or prepregs, measured 24" (61 cm) wide and thickness of 0.0026" (0.0066 cm). The prepreg contained 75% by weight of SPECTRA®-1000 and 25% by weight of KRATON D-1107 resin. The prepreg sheet was cut into 12" (30.5 cm)×12" (30.5 cm) layers and a total of 364 layers were subsequently stacked into a preform. The fibers in adjacent layers were perpendicular to each other in 0°, 90°, 0°, 90°, etc. The preform was molded at 110° C. under 50 tons sq. ft. (4,800 Kpa) pressure for about 30 minutes and cooled to room temperature. The molded panel, measured 12" (30.5 cm)× 12" (30.5 cm)×1" (2.54 cm) thick, had an areal density of 5 pounds per square ft. (1 kg/m$^2$). The panel was impacted by a designated threat and the measured V/50 was 3,200 ft/sec (976 m/sec). Severe delamination and panel separation into numerous pieces were observed.

EXAMPLE 1

Comparative Example 1 was repeated except that, prior to the molding of preform of 364 layers with 0°, 90°, 0°, 90°, . . . orientation into a panel, the preform was lightly pressed under a pressure of 5 tons per square ft (480 kg/m$^3$). and room temperature of 23° C. The preform was measured approximately 12" (30.5 cm)×12" (30.5 cm)×1.25" (3.18 cm) thick and was stitched using SPECTRA®-1000 yarns of 7,800 denier with a breaking strength of approximately 570 lbs (260 kg). The stitched linear path was kept at 1" (2.54 cm) away from the peripheral edge of the preform. In addition to the peripheral stitch, the preform was also stitched vertically and horizontally to bisect the preform into four reinforced quadrants. The vertical stitched yarn penetrating through the preform was 1.25" (3.18 cm) while the yarn was loosely stitched horizontally along the top and bottom preform surfaces. The yarn lengths on top and bottom surfaces were 0.75" (1.9 cm) and 0.75" (1.9 cm), respectively, as compared to the shortest horizontal distance of 0.5" (1.27 cm) between the two needle stitching points (exit and entrance on the surface). The stitch length was 4" (10.2 cm).

The preform was molded, according to Comparative Example 1, into a panel of 12" (30.5 cm)×12" (30.5 cm)×1" (2.54 cm) thickness with an areal density of 5.2 lbs/ft$^2$ (1.04 kg/m$^2$). The stitch path was 3" (7.6 cm)=1" (2.54 cm)×2 (vertical)+0.5" (1.3 cm) (top surface)+0.5" (1.3 cm) (bottom surface). The difference of the stitched yarn length (=4") (10.2 cm) and the stitch path length (=3") (7.6 cm) was 1" which allowed the panel, upon impact, to delaminate at a controlled level of 1" (2.54 cm) maximum. The panel was impacted against the same type of projectile as shown in Comparative Example 1, and the V/50 was 3,478 ft/sec (1,060 m/s).

COMPARATIVE EXAMPLE 2

Comparative Example 1 was repeated except that the designated ballistic projectile impacted the panel without stitching at a velocity of 2,750 fps (838 m/sec). After the first shot, the projectiles only partially penetrate the panel. After three shots, the panel was completely delaminated into several pieces which was unsuitable for armor use. The maximum multiple hit capability was less than three.

EXAMPLE 2

Example 1 was repeated except that the designated ballistic projectiles impacted the stitched panel at a velocity of 2,750 fps (838 m/sec). No panel penetration was observed under this velocity. After six shots no panel separation was observed due to loose stitching. The maximum multiple hit capability of the stitched panel was six (6) which shows a significant improvement over the panel without stitching described in Comparative Example 2.

What is claimed is:

1. A rigid penetration resistant composite comprising a plurality of fibrous layers comprising a network of fibers in a polymeric matrix selected from the group consisting of thermoplastic polymers, thermosetting resins or a combination thereof, at least two of said layers secured together by a stitching means which comprises slack fiber stitches wherein the average stitch length is at least 110% of the average stitch path.

2. The improved composite of claim 1 wherein the fiber of the stitches has a tenacity in the range of about 7 to about 50 grams/denier and a modulus in the range of about 40 to about 3000 grams/denier.

3. The improved composite of claim 1 wherein said fiber stitches are formed from fiber selected from the group consisting of polyethylene fiber, aramid fiber, nylon fiber, polyester fiber, glass fiber and any combination thereof.

4. The improved composite of claim 3 wherein said fiber is polyethylene fiber.

5. The improved composite of claim 3 wherein said fiber is aramid fiber.

6. The improved composite of claim 1 wherein the stitch length is up to about 300% of the stitch path.

7. The improved composite of claim 1 wherein the stitch length is up to about 150% of the average stitch path.

8. The improved composite of claim 1 wherein said composite comprises from about 10 to about 1500 fibrous layers.

9. A process for forming the composite of claim 1 which comprises the steps of:

a) securing a plurality of adjacent fibrous layers each of which comprises a network of fibers dispersed in a polymeric matrix by a plurality of stitches having an average first stitch length and having an average first stitch path wherein said first stitch length is equal to or substantially equal to said first stitch path to form a composite having a 1st thickness, $t_1$; and b) compressing said first composite at a temperature and pressure to form a penetration resistant second composite having a second thickness $t_2$ a second stitch length and a second stitch path wherein said first thickness, $t_1$, is greater than said second thickness said second stitch length is equal to or substantially equal to said first stitch length and wherein said second stitch path is less than said first stitch path.

10. An article of manufacture comprising a body which is formed totally or in part from the composite of claim 1.

11. The article of claim 10 which is a penetration resistant armor.

12. The article of claim 10 which is a blast resistant compartment.

13. The improved composite of claim 1 wherein the slack of the fiber stitches is substantially inside of the composite.

* * * * *